United States Patent [19]

Mendenhall

[11] Patent Number: 4,958,390

[45] Date of Patent: Sep. 25, 1990

[54] REST COT ASSEMBLY

[75] Inventor: David L. Mendenhall, Wilsonville, Oreg.

[73] Assignee: Holbrook-Patterson, Inc., Coldwater, Mich.

[21] Appl. No.: 267,525

[22] Filed: Nov. 4, 1988

[51] Int. Cl.[5] ..... A47C 19/00

[52] U.S. Cl. ..... 5/110; 5/111; 5/201; 5/8

[58] Field of Search ..... 5/8, 110, 111, 114, 5/200 C, 201, 202 B, 289, 301, 310; 403/290, 309, 313, 371, 373

[56] References Cited

U.S. PATENT DOCUMENTS

| | | | |
|---|---|---|---|
| 2,621,879 | 12/1952 | Lundeen | 248/120 |
| 2,646,577 | 7/1953 | Thayer | 5/111 X |
| 2,670,478 | 3/1954 | Gilfillan | 5/114 |
| 2,678,787 | 5/1954 | Averill | 248/120 |
| 2,721,338 | 10/1955 | Resnick | 5/201 |
| 2,791,325 | 5/1957 | Schecter et al. | 206/65 |
| 2,863,568 | 12/1958 | Skubic | 211/148 |
| 2,871,489 | 2/1959 | Emmert | 5/114 |
| 2,916,239 | 12/1959 | Stopps | 248/120 |
| 2,924,830 | 2/1960 | DeLong | 5/8 |
| 3,021,049 | 2/1962 | Settle | 403/290 X |
| 3,321,863 | 5/1967 | Maxum, Jr. | 403/290 X |
| 3,400,671 | 9/1968 | Erismann | 108/53 |
| 3,426,367 | 2/1969 | Bradford | 5/114 X |

*Primary Examiner*—Michael F. Trettel
*Attorney, Agent, or Firm*—Jay K. Malkin

[57] ABSTRACT

An improved rest cot is provided which includes a plurality of elongate support members arranged to form a frame having a canvas or cloth panel secured thereto. The ends of the support members are attached to each other using specially designed corner pieces. Each corner piece includes a downwardly extending leg constructed of multiple tubular sections. The leg of one corner piece is designed to nest within the leg of another corner piece so that storage of the cots in a stacked configuration is facilitated. Each corner piece also includes two open attachment sections each designed to receive one support member. The attachment sections individually include multiple engagement members sized to receive a support member. Once a support member is received between the engagement members, they are urged together against the support member using a collar which is secured to the corner piece by a mechanical fastener.

24 Claims, 3 Drawing Sheets

REST COT ASSEMBLY

BACKGROUND OF THE INVENTION

The present invention generally relates to portable rest cots, and more particularly to a rest cot of improved design which is easily stored, assembled and used.

Portable rest cots are becoming increasingly popular for many purposes, including use in the day care industry. Typical rest cots include a substantially rectangular frame having a suspended portion of canvas or cloth designed to support a child or other user. The frame is preferably constructed of a plurality of individual tubular members made of aluminum or other durable material.

It is important that rest cots used on a daily basis (e.g. in the day care industry) be of durable construction and easily assembled/disassembled with minimal effort. It is also important that the cots include a minimal number of detachable components (for safety reasons). Finally, they must be readily storable in a small amount of space when not in use. The present invention represents a rest cot assembly of improved design which satisfies these goals in a manner not heretofore known or used, as described below.

SUMMARY OF THE INVENTION

It is an object of the present invention to provide a rest cot of light-weight construction which includes a minimal number of components.

It is another object of the invention to provide a rest cot which is easily assembled and disassembled.

It is another object of the invention to provide a rest cot which is safe, strong, and durable.

It is a further object of the invention to provide a rest cot which uses readily available, inexpensive components.

It is a still further object of the invention to provide a rest cot which is readily stored in a stacked configuration in which successive cots are positioned on top of each other.

It is an even further object of the invention to provide a rest cot which is easily cleaned after use.

In accordance with the foregoing objects, a rest cot of improved design is provided which includes a plurality of elongate structural support members secured together to form a substantially rectangular frame having a canvas or cloth portion secured thereto. The ends of the support members are secured to each other using specially designed, substantially triangular corner pieces. The corner pieces each include a downwardly extending leg portion having a first tubular section and a second tubular section smaller in diameter than the first tubular section. Both tubular sections incorporate a plurality of reinforcing ribs to maintain structural integrity. Each leg portion of one cot is designed to nest within the leg portion of another cot so that the cots may be stacked for storage purposes. In addition, each corner piece also includes two open attachment sections designed to receive the structural support members used to make the frame. The attachment sections individually include at least two resilient engagement members arcuate in cross section and preferably arranged concentrically. The engagement members in each attachment section are designed to receive one of the structural support members. Once a support member is received between the engagement members, they are urged together against the support member using a collar which is slipped over the support member. The collar is then secured to the corner piece by a mechanical fastener, thereby maintaining the support member in a secure position relative to the corner piece.

These and other objects, features, and advantages of the invention will be described below in the following brief description of the drawings and detailed description of a preferred embodiment.

DETAILED DESCRIPTION OF A PREFERRED EMBODIMENT

Figure 1:
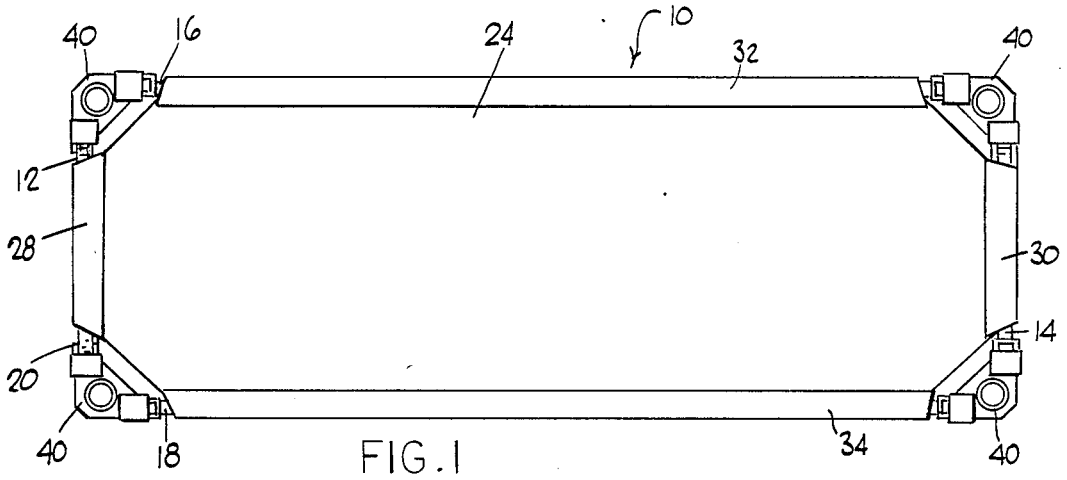
FIG. 1 is a top view of a rest cot incorporating corner pieces produced in accordance with the invention.
Figure 2:
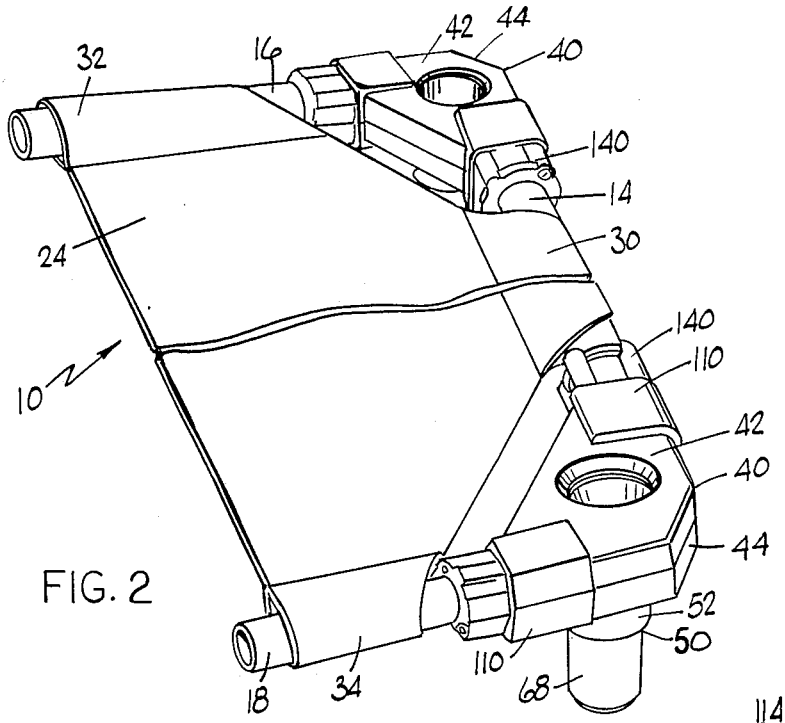
FIG. 2 is an enlarged perspective view of one end of the cot of FIG. 1.

The present invention involves a rest cot characterized by improved stability and user convenience. In addition, it is readily stored in a minimal amount of space when not in use. With reference to FIGS. 1 and 2, a rest cot 10 produced in accordance with the invention is shown. The cot includes elongate structural support members 12, 14, 16, 18 which are preferably manufactured of tubular aluminum or other light-weight, durable material. Support members 12, 14 are of substantially equivalent length, as are support members 16, 18. Support members 12, 14 are shorter than support members 16, 18, and when assembled as shown in FIG. 1, form a substantially rectangular frame 20.

Suspended from the frame 20 is a panel 24 comprised of canvas, cloth, or other durable, water-resistant material known in the art. The panel 24 includes sleeve portions 28, 30, 32, and 34 each having a diameter exceeding that of the support members 12, 14, 16, 18. This design enables insertion of the support members 12, 14, 16, 18 within the sleeve portions 28, 30, 32, 34 as shown in FIGS. 1 and 2.

Figure 3:
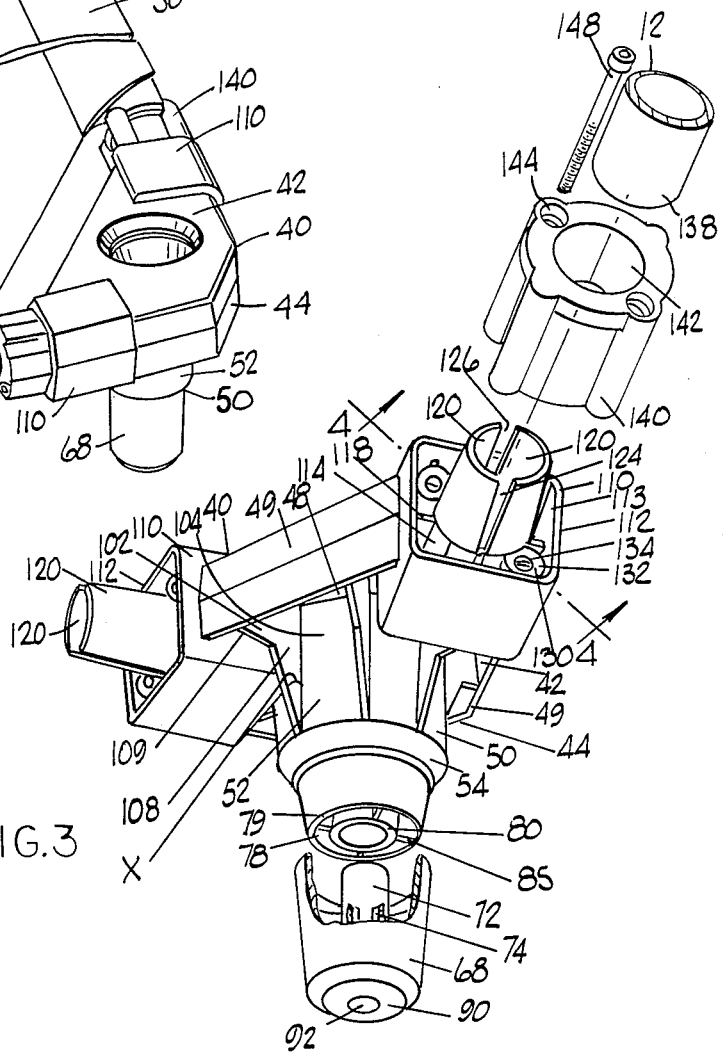
FIG. 3 is a bottom, partially exploded perspective view of a corner piece used in the cot of FIG. 1.
Figure 5:
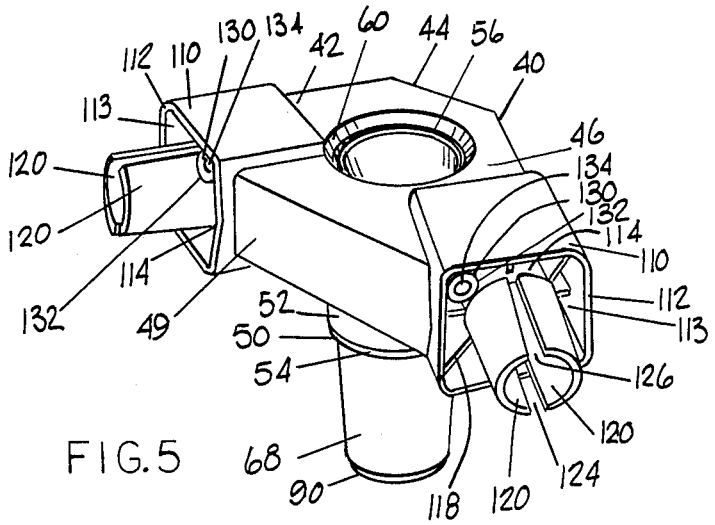
FIG. 5 is a top perspective view of the corner piece of FIG. 3.
Figure 9:
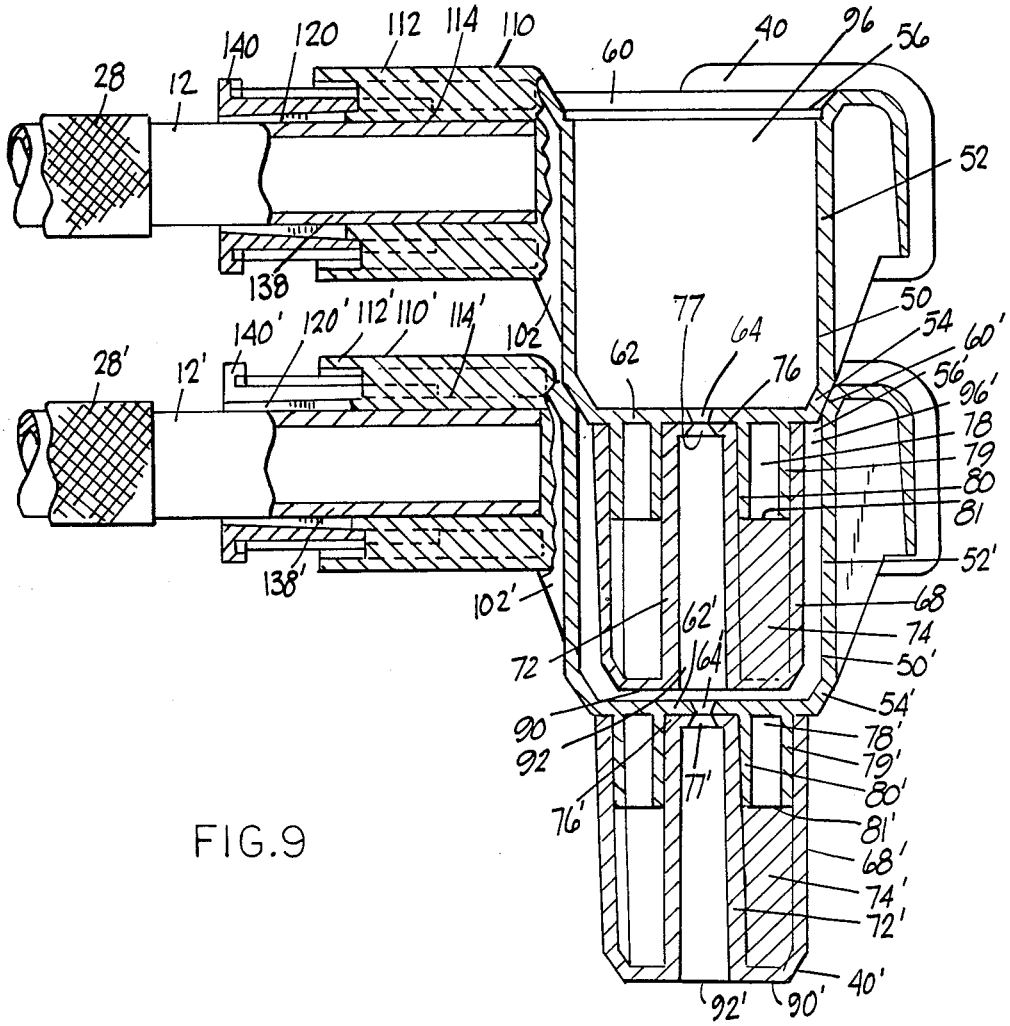
FIG. 9 is a cross sectional view of two corner pieces shown in a nested configuration.

At each corner of the frame 20, a corner piece 40 is provided. Each corner piece 40 is preferably of molded construction, and manufactured using a durable plastic known in the art (e.g. polypropylene). With reference to FIGS. 3, 5, 7, and 8, corner piece 40 includes a substantially triangular body portion 42 having a beveled apex 44. The body portion 42 also includes an upper face 46, a lower face 48, and downwardly extending side walls 49 (FIGS. 3, 5, and 7). Also extending downwardly from the body portion 42 is a leg 50. The leg 50 is constructed of multiple tubular sections shown in FIGS. 3, 5, and 6. Specifically, a first tubular section 52 is provided which is open at the upper face 46 of the body portion 42, as illustrated in FIG. 5. With reference to FIGS. 3 and 9, the first tubular section 52 includes a frustoconical lower region 54 and an upper region 56 having an inwardly angled interior wall 60 adjacent the upper face 46 of the body portion 42. This design enables the frustoconical lower region 54 of one corner piece 40 to matingly engage with the inwardly angled interior wall 60 of another corner piece 40 so that the corner pieces 40 may be appropriately nested for storage purposes, as shown in FIG. 9 and described further below.

Integral with the frustoconical lower region 54 of the first tubular section 52 is a substantially planar horizontal wall 62 having at least one opening 64 therethrough (FIG. 9). The opening 64 is designed to function as a drain hole when the corner piece 40 is rinsed with water or other liquid cleaning agents.

Extending downwardly from the wall 62 is a second tubular section 68 having a diameter smaller than that of the first tubular section 52 (FIGS. 3 and 9). The second tubular section 68 includes an interior tubular member 72 shown in FIGS. 3 and 9. The interior tubular member 72 is secured to and within the second tubular section 68 using a plurality of support ribs 74 (preferably six in number) illustrated in FIGS. 3 and 9. The interior tubular member 72 has an upper interior wall 76 adjacent wall 62 having an opening 77 therethrough substantially aligned with the opening 64 in the wall 62 to again facilitate water drainage during cleaning.

Secured to the wall 62 is a downwardly extending retaining portion 78 designed to secure the second tubular section 68 to the first tubular section 52 (FIGS. 3 and 9). The retaining portion 78 includes a first annular section 79 having a slightly smaller diameter than that of the second tubular section 68. Accordingly, the second tubular section 68 is designed to fit over and frictionally engage the first annular section 79 as shown.

Also included within the first annular section 79 of the retaining portion 78 is a second annular section 80. The second annular section 80 has a diameter slightly larger than that of the interior tubular member 72 in the second tubular section 68. Accordingly, the interior tubular member 72 is designed to fit within and frictionally engage the second annular section 80 as illustrated.

The aforesaid arrangement of components enables the second tubular section 68 to be tightly held against the wall 62 at the bottom of the first tubular section 52. In this configuration, opening 64 in the wall 62 is substantially aligned with opening 77 in the wall 76 of the interior tubular member 72 as previously discussed.

To provide added strength and structural stability, a plurality of support ribs 85 (preferably 4) are secured to and between the first annular section 79 and the second annular section 80 of the retaining portion 78 (FIG. 3). So that the ribs 85 do not engage the ribs 74 in the second tubular section 68, the ribs 74 terminate at position 81 directly beneath the retaining portion 78 (FIG. 9). This allows the second tubular section 68 to be properly fitted against wall 62.

The bottom 90 of each leg 50 includes an opening 92 (FIGS. 3 and 9) which is axially aligned with openings 64, 77. The opening 92 may be used to receive a conventional rolling caster or the like (not shown).

Figure 6:
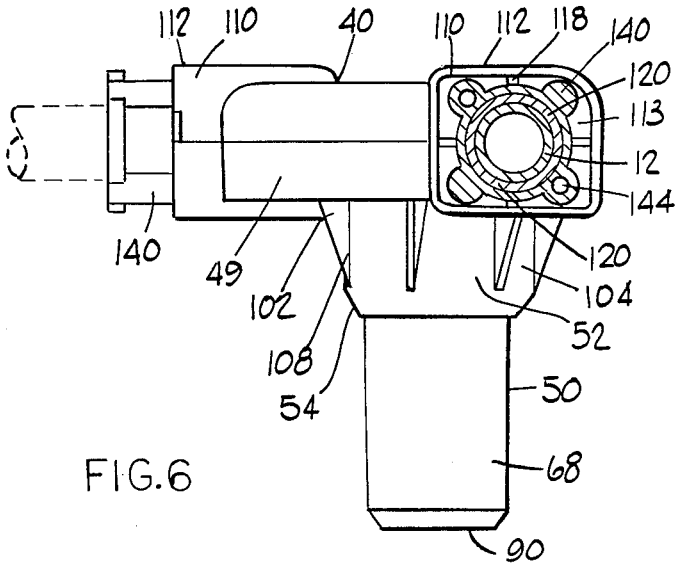
FIG. 6 is a side view of the corner piece of FIG. 3.
Figure 7:
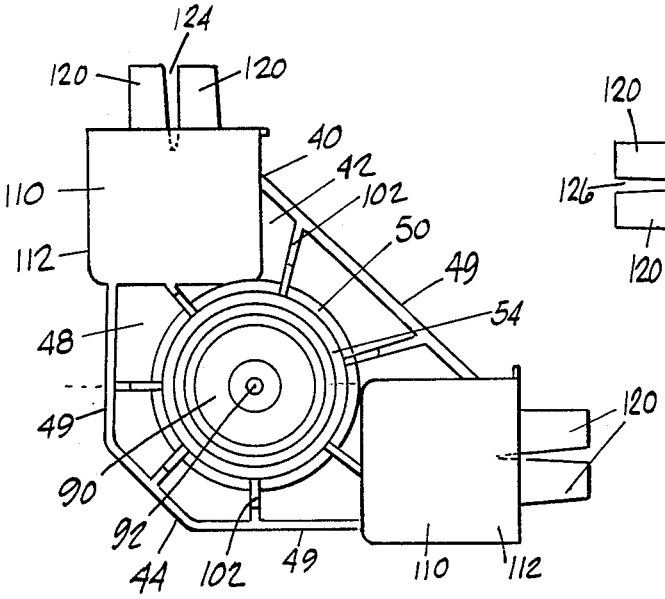
FIG. 7 is a bottom view of the corner piece of FIG. 3.
Figure 8:
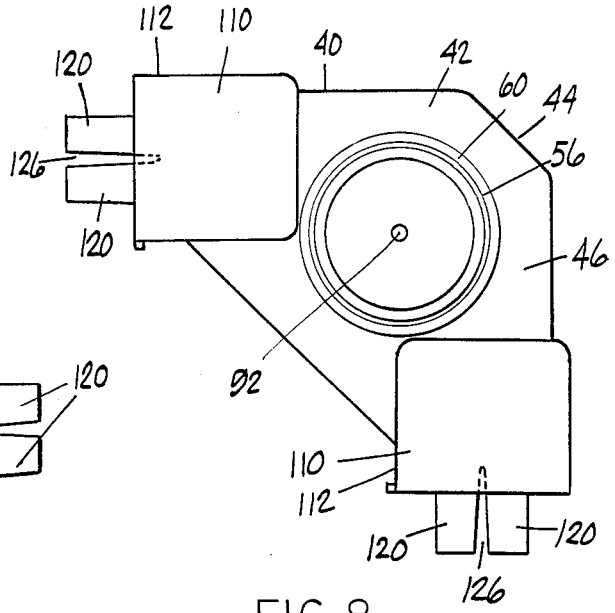
FIG. 8 is a top view of the corner piece of FIG. 3.

The entire leg 50 of each corner piece 40 is stabilized using a plurality of ribs 102 (preferably seven) which are secured to the annular exterior surface 104 of the first tubular section 52, the side walls 49 of the body portion 42, and the lower face 48 of the body portion 42 (FIGS. 3, 6, and 7). The ribs 102 each have a first portion 108 which extends outwardly from the first tubular section 52 of the leg 50 at an acute angle "X" shown in FIG. 3 (about 30°). The second portion 109 of each rib 102 is preferably secured to one of the side walls 49 of the body portion 42 and the lower face 48 of the body portion 42 as illustrated.

The second tubular section 68 which represents the lower half of leg 50 has a smaller diameter than that of the first tubular section 52 as previously described, so that the second tubular section 68 will fit within the interior 96 of the first tubular section 52 of another corner piece 40 (FIG. 9). This enables the cots 10 of the invention to be stacked for storage purposes, as described in greater detail below.

Referring now to FIGS. 3–6, the body portion 42 also includes dual attachment sections 110 extending outwardly from the body portion 42. Each attachment section 110 includes a main section 112, an open region 113 therein, and a tubular section 114 within the open region 113 as shown in FIGS. 3, 5, and 6. The tubular section 114 is secured in position using a plurality of ribs 118 attached to and between the tubular section 114 and the main section 112 (FIG. 6).

The tubular section 114 terminates in a plurality of outwardly extending resilient engagement members 120 which are preferably arcuate in cross section, inwardly tapered and arranged in a substantially concentric orientation (FIGS. 3, 5, 5 and 6). In a preferred embodiment, two substantially semicircular engagement members 120 are provided which are spaced from each other at positions 124, 126 (FIG. 5). The engagement members 120 are designed to receive one of the support members 12, 14, 16, 18 therebetween.

Figure 4:
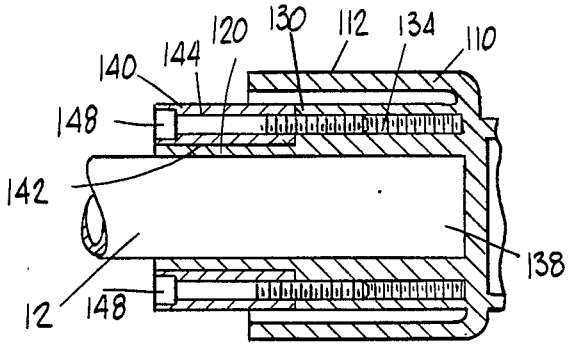
FIG. 4 is a sectional view taken along lines 4-4 of FIG. 3.

With continued reference to FIGS. 3, 4, and 5, each attachment section 110 further includes a plurality of elongate studs 130 (preferably two) secured to and between the tubular section 114 and the main section 112 within the open region 113. Ends 132 of the elongate studs 130 include bores 134, the function of which will be described hereinafter.

OPERATIONAL AND STORAGE MODES

As previously indicated, the cot 10 of the present invention is designed to function in a safe, efficient, and convenient manner. It is also easily assembled/disassembled and stored when not in use. To assemble the cot 10, the elongate structural support members 12, 14, 16, 18 must be secured to corner pieces 40. With reference to FIG. 9, an elongate structural support member 12 is shown secured to a corner piece 40. This is accomplished by first placing an annular collar 140 (FIGS. 3, 4, and 9) over the end 138 of the support member 12. The collar 140 has a diameter greater than that of the support member 12, and readily passes thereover. The end 138 of the support member 12 is then placed between the engagement members 120 of the attachment section 110, and the collar 140 is urged downwardly over the engagement members 120. This forces the engagement members 120 slightly inward against the support member 12 to secure it rigidly in position. Since each engagement member 120 is slightly tapered inward, the annular interior surface 142 of each collar 140 is also tapered slightly outward so that it may more easily be fitted in position. The collar 140 also includes a plurality of longitudinal bores 144 (preferably two), as shown in FIGS. 3, and 4. The bores 144 are designed to register with the bores 134 in the elongate studs 130 as shown.

To complete the assembly process, threaded fasteners 148 (e.g. screws as shown in FIG. 3) are passed through the bores 144 in collar 140, threaded into the bores 134 in the elongate studs 130, and tightened. This procedure is undertaken for all of the remaining support members used to form the frame 20 of the cot 10. As a result, each attachment section 110 secures two support members in position, wherein the support members are perpendicularly oriented to each other. Disassembly of the frame 20 is accomplished by reversing the steps described above.

When not in use, cots produced in accordance with the invention are readily stacked in a nested arrangement on top of each other. Storage in this manner is facilitated by the structural design of the corner pieces 40 as previously described. Two nested corner pieces 40, 40' are shown in FIG. 9. As illustrated, the frustoconical lower region 54 of the leg 50 of corner piece 40 is matingly engaged with the inwardly angled interior wall 60' of the leg 50' of the corner piece 40'. Likewise, the second tubular section 68 of the leg 50 of the corner piece 40 is positioned within the interior 96' of the first tubular section 52' of the corner piece 40'.

Having herein described a preferred embodiment of the invention, it is anticipated that suitable modifications may be made thereto by individuals skilled in the art. Thus, the invention shall only be construed in accordance with the following claims.

What is claimed is:

1. A corner piece adapted to secure and engage the elongate structural support members of a rest cot comprising:

a body portion;

a first attachment section for receiving one of said support members of said cot;

a second attachment section for receiving another of said support members of said cot, said first attachment section being positioned relative to said second attachment section so that a support member received by said first attachment section is perpendicular to a support member received by said second attachment section;

a leg positioned between said first and second attachment sections and extending downwardly from said body portion, said leg comprising a first tubular section extending through said body portion and opening at the top of said body portion, and a second tubular section secured to and extending downwardly from said first tubular section, said second tubular section having a diameter less than that of said first tubular section, said second tubular section of one corner piece being adapted to fit within said first tubular section of another corner piece; and a wall between said first and second tubular sections of said leg, said wall having at least one orifice therethrough.

2. The corner piece of claim 1 wherein said second tubular section of said leg further comprises an interior tubular member positioned within said second tubular section.

3. The corner piece of claim 2 wherein said wall further comprises a downwardly extending retaining portion secured thereto, said retaining portion comprising a first annular section having a diameter smaller than that of said second tubular section, said second tubular section being adapted to fit over and against said first annular section.

4. The corner piece of claim 3 wherein said retaining portion further comprises a second annular section positioned within said first annular section, said second annular section having a diameter larger than that of said interior tubular member of said second tubular section, said interior tubular member being adapted for receipt within said second annular section.

5. The corner piece of claim 1 wherein said first tubular section comprises an upper portion and a lower portion, said lower portion comprising a frustoconical section adjacent said wall between said first and said second tubular sections of said leg, said upper portion comprising an inwardly angled interior surface, said frustoconical section of one corner piece being adapted for receipt within and against said inwardly angled interior surface of another corner piece.

6. The corner piece of claim 1 wherein said leg is secured to said body portion using a plurality of reinforcing ribs secured to said first tubular section of said leg and said body portion.

7. The corner piece of claim 6 wherein said reinforcing ribs each form an acute angle relative to said leg.

8. The corner piece of claim 1 wherein said first and second attachment sections each comprise a tubular connecting section terminating in a plurality of outwardly extending engagement members adapted to receive one of said elongate structural support members therebetween.

9. The corner piece of claim 8 further comprising a plurality of collar members each having an opening therethrough, one of said collar members being secured to each of said first and second attachment sections, said outwardly extending engagement members of each of said tubular connecting sections being positioned within said opening of one of said collar members so as to urge said engagement members inwardly against a support member positioned therebetween.

10. A corner piece adapted to secure and engage the elongate structural support members of a rest cot comprising:

a body portion;

a first attachment section for receiving one of said support members of said cot comprising an open region therein and a tubular connecting section fixedly positioned within said open region, said tubular connecting section terminating in a plurality of outwardly extending engagement members adapted to receive one of said support members therebetween;

a second attachment section for receiving another of said support members of said cot comprising an open region therein and a tubular connecting section fixedly positioned within said open region, said tubular connecting section terminating in a plurality of outwardly extending engagement members adapted to receive one of said support members therebetween, said first attachment section being positioned relative to said second attachment section so that a support member received by said first attachment section is perpendicular to a support member received by said second attachment section, said tubular connecting sections of said first and second attachment sections each being secured therein using a plurality of reinforcing ribs;

a collar member having an opening therethrough secured to each of said first and second attachment sections, said outwardly extending engagement members of said each of said tubular connecting sections being positioned within said opening of said collar member so as to urge said engagement members inwardly against a support member positioned therebetween;

a leg positioned between said first and second attachment sections and extending downwardly from said body portion, said leg comprising:

a first tubular section extending through said body portion and opening at the top of said body portion, said first tubular section comprising an upper portion and a lower portion, said lower portion comprising a frustoconical section, said upper portion comprising an inwardly angled interior surface, said frustoconical section of one corner piece being adapted for recipt within and against said inwardly angled interior surface of another corner piece;

a wall at said lower portion of said first tubular section having at least one orifice therethrough;

a downwardly extending retaining portion secured to said wall, said retaining portion further comprising a first annular section and a second annular section positioned within said first annular section and secured thereto using a plurality of reinforcing ribs; and a second tubular section secured to said retaining portion and extending downwardly form said first tubular section, said second tubular section having a diameter less than that of said first tubular section, said second tubular section of one corner piece being adapted to fit within said first tubular section of another corner piece;

said second tubular section comprising an interior tubular member positioned therein and secured thereto using a plurality of reinforcing ribs, said second tubular section having a diameter greater than that of said first annular section of said retaining portion so as to permit said second tubular section to fit over and against said first annular section;

said second annular section of said retaining portion having a diameter larger than that of said interior tubular member of said second tubular section, said interior tubular member being adapted for receipt within said second annular section; and a plurality of reinforcing ribs secured to said body portion and said first tubular section of said leg.

11. A rest cot comprising:

a substantially rectangular frame comprising a plurality of elongate structural support members secured together;

a flexible support panel suspended from said frame; and a corner piece positioned at each corner of said frame for securing said structural support member together, said corner piece comprising:

a body portion;

a first attachment section for receiving one of said support members of said cot;

a second attachment section for receiving another of said support members of said cot, said first attachment section being positioned relative to said second attachment section so that a support member received by said first attachment section is perpendicular to a support member received by said second attachment section;

a leg positioned between said first and second attachment sections and extending downwardly from said body portion, said leg comprising a first tubular section extending through said body portion and opening at the top of said body portion, and a second tubular section secured to and extending downwardly form said first tubular section, said second tubular section having a diameter less than that of said first tubular section, said second tubular section of one corner piece being adapted to fit within said first tubular section of another corner piece; and a wall between said first and second tubular sections of said leg, said wall having at least one orifice therethrough.

12. The rest cot of claim 11 wherein said second tubular section of said leg of said corner piece further comprises an interior tubular member positioned within and secured to said second tubular section.

13. The rest cot of claim 12 wherein said wall of said corner piece further comprises a downwardly extending retaining portion secured thereto, said retaining portion comprising a first annular section having a diameter smaller than that of said second tubular section, said second tubular section being adapted to fit over and against said first annular section.

14. The rest cot of claim 13 wherein said retaining portion of said corner piece further comprises a second annular section positioned within said first annular section, said second annular section having a diameter larger than that of said interior tubular member of said second tubular section, said interior tubular member being adapted for receipt within said second annular section.

15. The rest cot of claim 11 wherein said first tubular section of said leg of said corner piece comprises an upper portion and a lower portion, said lower portion comprising a frustoconical section adjacent said wall between said first and said second tubular sections of said leg, said upper portion comprising an inwardly angled interior surface, said frustoconical section of one corner piece being adapted for receipt within and against said inwardly angled interior surface of another corner piece.

16. The rest cot of claim 11 wherein said first and second attachment sections of said corner piece each comprise a tubular connecting section terminating in a plurality of outwardly extending engagement members adapted to receive one of said elongate structural support members therebetween.

17. The rest cot of claim 16 wherein said corner piece further comprises a plurality of collar members each having an opening therethrough, one of said collar members being secured to each of said first and second attachment section, said outwardly extending engagement members of each of said tubular connection sections being positioned within said opening of one of said collar members so as to urge said engagement members inwardly against a support member positioned therebetween.

18. A rest cot comprising:

a substantially rectangular frame comprising a plurality of elongate structural support members secured together;

a flexible support panel suspended from said frame; and a corner piece positioned at each corner of said frame for securing said structural support members together, said corner piece comprising:

a body portion;

a first attachment section for receiving one of said support members of said cot comprising an open region therein and a tubular connecting section fixedly positioned within said open region, said tubular connecting section terminating in a plurality of outwardly extending engagement members adapted to receive one of said support members therebetween;

a second attachment section for receiving another of said support members of said cot comprising an open region therein and a tubular connecting section fixedly positioned within said open region, said tubular connecting section terminating in a plurality of outwardly extending engagement members adapted to receive one of said support members therebetween, said first attachment section being positioned relative to said second attachment section so that a support member received by said first attachment section is perpendicular to a support member received by said second attachment section, said tubular connecting sections of said first and second attachment sections each being secured therein using a plurality of reinforcing ribs;

a collar member having an opening therethrough secured to each of said first and second attachment sections, said outwardly extending engagement members of each of said tubular connecting sections being positioned within said opening of said collar member so as to urge said engagement members inwardly against a support member positioned therebetween;

a leg positioned between said first and second attachment sections and extending downwardly form said body portion, said leg comprising:

a first tubular section extending through said body portion and opening at the top of said body portion, said first tubular section comprising an upper portion and a lower portion, said lower portion comprising a frustoconical section, said upper portion comprising an inwardly angled interior surface, said frustoconical section of one corner piece being adapted for receipt within and against said inwardly angled interior surface of another corner piece;

a wall at said lower portion of said first tubular section having at least one orifice therethrough;

a downwardly extending retaining portion secure to said wall, said retaining portion further comprising a first annular section and a second annular section positioned within said first annular section positioned within said first annular section and secured thereto using a plurality of reinforcing ribs; and a second tubular section secured to said retaining portion and extending downwardly form said first tubular section, said second tubular section having a diameter less than that of said first tubular section, said second tubular section of one corner piece being adapted to fit within said first tubular section of another corner piece;

said second tubular section comprising an interior tubular member positioned therein and secured thereto using a plurality of reinforcing ribs, said second tubular section having a diameter greater than that of said first annular section of said retaining portion so as to permit said second tubular section to fit over and against said first annular section;

said second annular section of said retaining portion having a diameter larger than that of said interior tubular member of said second tubular section, said interior tubular member being adapted for receipt within said second annular section; and a plurality of reinforcing ribs secured to said body portion and said first tubular section of said leg.

19. A corner piece adapted to secure and engage the elongate structural support members of a rest cot comprising:

a body portion;

a first attachment section for receiving one of said support members of said cot;

a second attachment section for receiving another of said support members of said cot, said first attachment section being positioned relative to said second attachment section so that a support member received by said first attachment section is perpendicular to a support member received by said second attachment section; and a leg positioned between said first and second attachment sections and extending downwardly from said body portion, said leg comprising a first tubular section extending through said body portion and opening at the top of said body portion, said first tubular section terminating in a downwardly extending retaining portion having a diameter less than that of said first tubular section, said leg further comprising a second tubular section having a diameter greater than that of said downwardly extending retaining portion of said first tubular section, said second tubular section being adapted to fit over and against said downwardly extending retaining portion, said second tubular section having a diameter less than that of said first tubular section, said second tubular section of one corner piece being adapted to fit within said first tubular section of another corner piece.

20. A rest cot comprising:

a substantially rectangular frame comprising a plurality of elongate structural support members secured together;

a flexible support panel suspended from said frame; and a corner piece positioned at each corner of said frame for securing said structural support members together, said corner piece comprising:

a body portion;

a first attachment section for receiving one of said support members of said cot;

a second attachment section for receiving another of said support members of said cot, said first attachment section being positioned relative to said second attachment section so that a support member received by said first attachment section is perpendicular to a support member received by said second attachment section; and a leg positioned between said first and second attachment sections and extending downwardly from said body portion, said leg comprising a first tubular section extending through said body portion and opening at the top of said body portion, first tubular section terminating in a downwardly extending retaining portion having a diameter less than that of said first tubular section, said leg further comprising a second tubular section having a diameter greater than that of said downwardly extending retaining portion of said first tubular section, said second tubular section being adapted to fit over and against said downwardly extending retaining portion, said second tubular section having a diameter less than that of said first tubular section, said second tubular section of one corner piece being adapted to fit within said first tubular section of another corner piece.

21. A corner piece adapted to secure and engage the elongate structural support members of a rest cot comprising:

a body portion having a beveled apex;

a first attachment section for receiving one of said support members of said cot;

a second attachment section for receiving another of said support members of said cot, said first attachment section being positioned relative to said second attachment section so that a support member received by said first attachment section is perpendicular to a support member received by said second attachment section, said second attachment section and first attachment section being spaced at an equal distance from said beveled apex of said body portion; and a leg positioned between said first and second attachment sections and extending downwardly from said body portion, said leg comprising a first tubular section extending through said body portion and opening at the top of said body portion, and a second tubular section secured to and extending downwardly from said first tubular section, said second tubular section having a diameter less than that of said first tubular section, said second tubular section of one corner piece being adapted to fit within said first tubular section of another corner piece.

22. A rest cot comprising:

a substantially rectangular frame comprising a plurality of elongate structural support members secured together;

a flexible support panel suspended from said frame; and a corner piece positioned at each corner of said frame for securing said structural support members together, said corner piece comprising:

a body portion having a beveled apex;

a first attachment section for receiving one of said support members of said cot;

a second attachment section for receiving another of said support members of said cot, said first attachment section being positioned relative to said second attachment section so that a support member received by said first attachment section is perpendicular to a support member received by said second attachment section, said second attachment section and first attachment section being spaced at an equal distance from said beveled apex of said body portion; and a leg positioned between said first and second attachment sections and extending downwardly form said body portion, said leg comprising a first tubular section extending through said body portion and opening at the top of said body portion, and a second tubular section secured to and extending downwardly from said first tubular section, said second tubular section having a diameter less than that of said first tubular section, said second tubular section of one corner piece being adapted to fit within said first tubular section of another corner piece.

23. A corner piece adapted to secure and engage the elongate structural support members of a rest cot comprising:

a body portion;

a first attachment section for receiving one of said support members of said cot comprising a tubular connecting section terminating in a plurality of outwardly extending engagement members adapted to receive one of said support members therebetween;

a second attachment section for receiving another of said support members of said cot comprising a tubular connecting section terminating in a plurality of outwardly extending engagement members adapted to receive one of said support members therebetween, said first attachment section being positioned relative to said second attachment section so that a support member received by said first attachment section is perpendicular to a support member received by said second attachment section;

a plurality of collar members each having an opening therethrough, one of said collar members being secured to each of said first and second attachment sections, said outwardly extending engagement members of each of said tubular connecting sections being positioned within said opening of one of said collar members so as to urge said engagement members inwardly against a support member positioned therebetween; and a leg positioned between said first and second attachment sections and extending downwardly from said body portion.

24. A rest cot comprising:

a substantially rectangular frame comprising a plurality of elongate structural support members secured together;

a flexible support panel suspended from said frame; and a corner piece positioned at each corner of said frame for securing said structural support members together, said corner piece comprising:

a body portion;

a first attachment section for receiving one of said support members of said cot comprising a tubular connecting section terminating in a plurality of outwardly extending engagement members adapted to receive one of said support members therebetween;

a second attachment section for receiving another of said support members of said cot comprising a tubular connecting section terminating in a plurality of outwardly extending engagement members adapted to receive one of said support members therebetween, said first attachment section being positioned relative to said second attachment section so that a support member received by said first attachment section is perpendicular to a support member received by said second attachment section;

a plurality of collar members each having an opening therethrough, one of said collar members being secured to each of said first and second attachment sections, said outwardly extending engagement members of each of said tubular connecting sections being positioned within said opening of one of said collar members so as to urge said engagement members inwardly against a support member positioned therebetween; and a leg positioned between said first and second attachment sections and extending downwardly from said body portion.

* * * * *